US006221819B1

(12) United States Patent
Chua

(10) Patent No.: US 6,221,819 B1
(45) Date of Patent: Apr. 24, 2001

(54) CLEANING OIL MADE FROM ANIMAL BONES

(76) Inventor: Aik Soong Chua, Blk 519 Pasir Ris St 52, #12-23, Singapore (SG)

( * ) Notice: Subject to any disclaimer, the term of this patent is extended or adjusted under 35 U.S.C. 154(b) by 0 days.

(21) Appl. No.: 09/341,172

(22) PCT Filed: Jan. 2, 1998

(86) PCT No.: PCT/SG98/00001

§ 371 Date: Aug. 25, 1999

§ 102(e) Date: Aug. 25, 1999

(87) PCT Pub. No.: WO98/30668

PCT Pub. Date: Jul. 16, 1998

(30) Foreign Application Priority Data

Jan. 8, 1997 (SG) ..... 9700026

(51) Int. Cl.[7] ..... C11D 7/44

(52) U.S. Cl. ..... 510/190; 510/245; 510/477; 510/488

(58) Field of Search ..... 510/190, 245, 510/477, 488

(56) References Cited

FOREIGN PATENT DOCUMENTS 59-175863 * 10/1984 (JP) .
3-297365 * 12/1991 (JP) .

* cited by examiner

*Primary Examiner*—John Hardee
(74) *Attorney, Agent, or Firm*—Christie, Parker & Hale, LLP

(57) ABSTRACT

A cleaning oil which is effective in removing dirt and soot from sooty surfaces such as artillery and gun barrels without causing corrosion and toxicity. The oil is produced by frying raw animal bones with used cooking oil until the bones become brown, and the oil becomes thick. The bone is then discarded, and the residual oil filtered and deodorised.

14 Claims, 1 Drawing Sheet

STEP 11 Add 200 Kg of animal bones to 100 liters of used cooking oil that has been preheated to approximately 80°C

↓

STEP 12 Increase temperature to 200°C until vigorous bubbling occurs

↓

STEP 13 Allow water content of the bones to evaporate from the oil without boiling over for 2-3 hours at approximately 80°C

↓

STEP 14 Remove bones form oil. Maintain oil temperature at 80°C

↓

Repeat STEPS 11-14

STEP 11 Add 200 Kg of animal bones to 100 liters of used cooking oil that has been preheated to approximately 80°C

↓

STEP 12 Increase temperature to 200°C until vigorous bubbling occurs

↓

STEP 13 Allow water content of the bones to evaporate from the oil without boiling over for 2-3 hours at approximately 80°C

↓

STEP 14 Remove bones form oil. Maintain oil temperature at 80°C

↓

Repeat STEPS 11-14

FIGURE 1

CLEANING OIL MADE FROM ANIMAL BONES

FIELD OF INVENTION

This invention relates to a safe and effective cleaning agent derived from used cooking oil enriched with minerals and other compounds from animal bones.

BACKGROUND OF INVENTION

Firearms that use gun powder such as rifles and artillery equipment need to have their barrels cleaned out after firing due to the accumulation of soot, dirt and other residues. Common cleaning agents for the removal of such sooty residues include lubricating oil, diesel fuel and engine oil. These substances can be corrosive and toxic to the human body, and need to be handled with care. Contact with the skin causes absorption into the body, and prolonged contact with the skin also causes wrinkling.

The use of animal bones for various purposes is well known. In one method, animal and fish bones are fried in used cooking coil for a short time. The treated bones are burnt to ashes and particles, and then used as pigments, fertilisers and polishing aids. These bone remains can also be used as additives in fine porcelain, filtering agent and deodoriser. The remaining cooking oil is normally used to manufacture low quality soap and wax.

OBJECT OF THE INVENTION

It is one object of this invention to describe an inexpensive cleaning agent for soot and carbon residues.

It is another object of this invention to reduce the harmful effect of handling such cleaning agents.

It is yet another objective of this invention to increase the efficiency of the soot cleaning process.

SUMMARY OF THE INVENTION

The present invention utilises used cooking oil as the main ingredient for a cleaning agent. The used cooking coil may be collected from restaurants and other food outlets. Thereafter, the oil is heated in the presence of animal bones. After discarding the bones, the residual oil, hereinafter called bone treated oil, is filtered and deodorised to give a mineral-enriched cleaning oil, which can be used directly as an effective cleaning agent to strip away carbon and soot on machine parts and firearms without causing corrosion and toxicity.

BRIEF DESCRIPTION OF DRAWINGS

FIG. 1 is a flow diagram to illustrate one process in which the present invention may be produced.

DESCRIPTION OF THE EMBODIMENT OF THE INVENTION

While this invention is herein illustrated and described as being achievable by one particular process, and described as being useful for one application, it is to be understood that the various features of this invention can be incorporated singly or in any combination thereof for the manufacture of a cleaning agent for various purposes.

FIG. 1 shows one method for the production of bone-treated oil. Used cooking oil and raw animal bones may be collected for example from food processing factories and butcher shops. A total of approximately 1,600 Kg of discarded animal bones such as from fish, sheep, swine and cattle, is heated in 100 liters of used cooking oil sequentially in batches of approximately 200 Kg of bones per batch. The 100 L of oil is first heated to approximately 80° C. Then approximately 200 Kg of bones is added to the oil (Step 11). Immediately thereafter, the temperature of the oil is increased to approximately 200° C. (Step 12). At this elevated temperature, the water content of the bones starts to evaporate rapidly, forming big bubbles in the oil. It is important at this point that the temperature be carefully controlled such that the oil does not boil over. Usually, this requires reducing the temperature to approximately 80° C. again, once vigorous bubbling due to water evaporation starts to occur in the oil. The bones are allowed to simmer in the oil at approximately 80° C. for 0.5 to 2.5 hours (Step 13), after which the oil is maintained at 80° C. while the bones are removed and discarded (Step 14). The bones should be removed from the oil, when they reach a light to dark brown colour, and before they become crispy. Steps 11–14 is repeated again as another cycle with another 200 Kg of raw bones being fried in the same 100 L of oil, until the entire 1,600 Kg of bones has been processed. Approximately 40 liters of bone-treated oil can be recovered for every 100 liters of oil used at the end of the entire process.

The aforementioned process is the preferred process for making the bone-treated oil. The preferred type of bone is the entire skeleton from small fish, or only the head bones of medium fish, swine, sheep and cattle. The most convenient amount of bones to use for each cycle is 200 Kg. However, smaller amounts can be used, e.g. 50 or 100 Kg, although this offers no advantage, as the number of cycles would have to be increased proportionally. The total amount of bones to be used can be approximately between 1,000 to 3,000 Kg, with 1,400 to 1,600 Kg being the preferred amount.

The temperature of the oil is kept between 80° C. to 200° C. for safety reasons. However, the temperature can be as high as 200° C. for Step 11, and 300° C. for step 12, so long as the oil does not boil over. The duration of frying time in Step 13 is between 0.5 and 2.5 hours at 80° C., with 1 to 2 hours being the preferred duration. For step 13, the duration can be lengthened to several hours if the temperature of the oil is lowered to below 80° C. or can be lengthened to several days if the heat is switched off entirely. The duration and the temperature of step 13 can be controlled in order to provide a convenient stopping or pausing point in between the cycles, and the bones in that cycle can be left in the oil. To start up another cycle after stopping or pausing, the oil is heated up to 80° C. again for 1–2 hours, the bones removed, and Steps 11 to 14 repeated.

The bone-treated oil is then filtered, and deodorized for example using activated carbon. The end product is an extremely effective, thick cleaning agent called mineral-enriched oil, for stripping soot from machine parts and firearms without causing corrosion to the parts. In addition, the oil is non-toxic, non-drying and non-corrosive to the human body.

The following Table 1 shows results of comparison studies using the mineral-enriched oil of the present invention compared to using lubricating, and engine oil for cleaning rifles. Singer oil was used in this study as an example of lubricating oil. Engine oil was also tested. The results of both the lubrication oil and engine oil was very similar, and have been combined as column 3 in Table 1. Diesel oil has also been tested, but the its performance was far poorer than either the lubrication or the engine oil. Far larger amounts of diesel oil is needed to perform the same cleaning task, therefore results for diesel oil are not included in Table 1.

Used cooking oil is also not effective as a cleaning agent for soot. For the ease of discussion, the term conventional oil will be used to refer to both lubrication and engine oils in the discussion of results presented in Table 1.

TABLE 1

| | Test | Present Invention | Lubricating/diesel Oil |
|---|---|---|---|
| A | Amount required for cleaning a 75 mm calibre gun barrel | 30 cc | 300 cc |
| B | Length of time required to clean gun barrel | 15–30 minutes | 120–150 minutes |
| C | Wrinkling effect on skin | Minimal wrinkling after 2 hours of exposure | Extensive wrinkling within 0.5 hours of exposure |

Tests A and B are semi-quantitative tests to determine the effectiveness of the two oils. Test A compares the volume of cleaning agent required to clean the soot from two 75 mm calibre gun barrels after firing the same number of shots. Results indicate that the mineral-enriched oil is ten times more effective as a cleaning agent in terms of the volume of oil required for cleaning. 300 cc of the conventional oil is required for the cleaning, while only 30 cc is required of the mineral-enriched oil. The mineral-enriched oil is so effective that only a few drops is required to clean the barrel of an M16 rifle. Diesel oil had the worst performance, requiring far larger amounts that the lubrication or machine oil to effect the same result (data not shown).

In terms of the length of time required to clean the two rifles, results from Test B shows that the mineral-enriched oil is again superior to the conventional oil. Only 15–30 minutes are required for cleaning with the mineral-enriched oil, while it takes 2 to 2.5 hours to achieve a similar cleanness when the conventional oil is used.

Test C is a qualitative test to determine the effect on the human skin upon exposure to the different oils, as determined by the extent of wrinkling caused. It was found that after exposure for up to 2 hours, few wrinkles developed using the mineral-enriched oil, but a high level of wrinkling developed within 30 minutes using the conventional oil. For sensitive individual, blistering would also occur within 30 minutes of using the conventional oil, but this does not happen with the mineral-enriched oil.

From the test results shown in Table 1, it can be seen that the oil of the present invention is superior to the conventional oil in all aspects tested. The oil can be safely handled by the cleaning personnel. This oil also shows greater efficiency in perform the task of soot cleaning. Since the amount of mineral-enriched oil required is only one tenth of the conventional oil, there is a great savings in costs. In addition, the amount required in storage is also proportionately reduced, resulting in further savings in costs. Furthermore, the smaller volume also means a lowered risk as a fire hazard. The benefit of lower space requirement is also important when combat situations are considered. Soldiers have to carry such cleaning agents with them during field combat, and since only a few drops of the mineral-enriched oil is required to clean the barrel of a rifle (for example a M16 rifle), compare to a much larger volume required for the conventional oil, there is the added benefit to individual military personnel.

What is claimed is:

1. A method of producing a cleaning oil which comprises the steps:

a. frying approximately 200 Kg of bones in 100 L of preheated cooking oil at 80–200° C. for approximately 0.5–2.5 hours;

b. reducing the temperature of said cooking oil to approximately 80° C.;

c. removing said bones from said cooking oil; and d. repeating steps (a) and (c) again seven to eight times.

2. A method according to claim 1 wherein said cleaning oil is filtered.

3. A method according to claim 1 wherein said cleaning oil is deodorised.

4. A method according to claim 1 wherein said cleaning oil is deodorised and filtered.

5. A cleaning oil produced according to the method in claim 1 wherein said cleaning oil has been filtered.

6. A cleaning oil produced according to the method in claim 1 wherein said cleaning oil has been deodorised.

7. A cleaning oil produced according to the method in claim 1 wherein said cleaning oil has been filtered and deodorised.

8. A method of removing dirt and soot from a sooty surface which comprising applying an effective amount of cleaning oil and cleaning said sooty surface, said cleaning oil being produced by frying animal bones with cooking oil whereby said bones become dehydrated and brown in colour and said cooking oil becomes thickened and thereafter removing said bones from said cooking oil.

9. A method according to claim 8 wherein said cleaning oil is filtered.

10. A method according to claim 8 wherein said bone-treated oil is deodorised.

11. A method according to claim 8 wherein said bone-treated oil is deodorised and filtered.

12. A method according to claim 8 wherein said sooty surface is metallic.

13. A method according to claim 8 wherein said soot is generated from ammunition firing.

14. A method according to claim 8 wherein said sooty surface is part of a firearm.

* * * * *